US010260214B2

(12) United States Patent
Rutherford

(10) Patent No.: US 10,260,214 B2
(45) Date of Patent: Apr. 16, 2019

(54) SLEWING ASSIST SYSTEM

(71) Applicant: Caterpillar Inc., Peoria, IL (US)

(72) Inventor: Stephen Platt Rutherford, Edwards, IL (US)

(73) Assignee: Caterpillar Inc., Deerfield, IL (US)

( * ) Notice: Subject to any disclaimer, the term of this patent is extended or adjusted under 35 U.S.C. 154(b) by 170 days.

(21) Appl. No.: 15/586,361

(22) Filed: May 4, 2017

(65) Prior Publication Data

US 2018/0320337 A1 Nov. 8, 2018

(51) Int. Cl.

| | |
|---|---|
| ***E02F 9/12*** | (2006.01) |
| *B66C 23/86* | (2006.01) |
| *B66C 23/84* | (2006.01) |

(52) U.S. Cl.

CPC ..... *E02F 9/123* (2013.01); *B66C 23/84* (2013.01); *B66C 23/86* (2013.01)

(58) Field of Classification Search

CPC .. E02F 9/123; E02F 9/121; E02F 9/12; B66C 23/84; B66C 23/86

See application file for complete search history.

(56) References Cited

U.S. PATENT DOCUMENTS

| | | | | |
|---|---|---|---|---|
| 6,199,442 | B1 * | 3/2001 | Bauer | B66C 23/94 188/31 |
| 8,668,041 | B2 * | 3/2014 | Yumoto | B62D 33/0617 180/291 |
| 8,855,872 | B2 * | 10/2014 | Yamazaki | B60W 30/18127 180/333 |
| 8,881,519 | B2 * | 11/2014 | Kamimura | E02F 9/123 60/414 |
| 9,004,217 | B2 * | 4/2015 | Okumura | E02F 9/2095 180/291 |
| 9,422,691 | B2 * | 8/2016 | Ueta | E02F 9/0866 |
| 9,828,049 | B2 * | 11/2017 | Lyle | E02F 3/325 |
| 2016/0319513 | A1 * | 11/2016 | Chen | E02F 9/024 |

FOREIGN PATENT DOCUMENTS

| | | |
|---|---|---|
| CN | 104340891 B | 7/2016 |
| GB | 793840 A | 4/1958 |
| GB | 819864 A | 9/1959 |

* cited by examiner

*Primary Examiner* — Joseph M Rocca
*Assistant Examiner* — Michael R Stabley

(57) ABSTRACT

A slewing assist system for a machine having an upper body structure supported on an undercarriage structure includes a central rotation member. The central rotation member is rotatably coupled to undercarriage structure. A slip member is concentrically coupled to central rotation member and allows a relative rotational motion. At least one pin is coupled to slip member and engages slip member in expanded position such that central rotation member and slip member rotate together. A lever arm is fixedly coupled to slip member. A first end and a second end of an actuating element are coupled to lever arm and upper structure, respectively. The slewing assist system provides additional slewing assist to upper body structure by engaging slip member and central rotation member through pin. The slewing assist system assists in a first and a second rotational direction by extending and retracting second end of actuating element, respectively.

20 Claims, 7 Drawing Sheets

SLEWING ASSIST SYSTEM

TECHNICAL FIELD

The present disclosure relates generally to slewing systems. More specifically, the present disclosure relates to slewing assist systems for operation with heavy equipment for mining, excavating, and construction etc.

BACKGROUND

Machines, such as excavators and power shovels, may include a deck or other platform that rotates above continuous tracks, wheels, pontoons, etc. Extending from the deck, the machine may further include a boom for an articulated arm or crane designed to operate a bucket, a breaker, a hook, or any other such work tool. Accordingly, such machines typically include one or more actuators designed to move the tracks, rotate the deck, and operate the articulated arm and work tool.

By way of example, an excavator or power shovel may typically operate in work cycles which may include digging, lifting, swinging, dumping, and returning steps for operating a bucket to dig and load fragmented rock, earth, minerals, overburden, and the like for mining or construction purposes. The operation of rotating the deck of the machine is generally powered by a motor or other such means. Most of the time the motor or such means are designed oversized to make the machine capable of operating under heavy loads. Other requirements may include making an existing or older machine handle operations like dredging, or any other such operation requiring to rotate the deck under heavy load on the bucket. Thus, the machine operates with a motor that is oversized for majority of its power demand profile. The oversized motor affects initial purchasing cost, operating and repairing costs, and any probability of retrofitting the existing or older machines to handle dredging operations.

G.B. Patent No. 8,198,64A (hereinafter referred to as '864 reference) describes a slewing motor for jibbed machines like cranes, excavators, etc. The '864 reference includes a pinion secured to a slewing part of the machine and a circular rack secured to a stationary part. The motion is provided by controlling valves providing operating fluid. However, the '864 reference does not disclose details about any solution for reduction in motor size or retrofitting older machines for dredging like operations.

Therefore, an improved slewing system for the machine is required.

SUMMARY

In an aspect of the present disclosure, a slewing assist system for a machine is provided. The machine includes an upper body structure supported on an undercarriage structure such that the upper body structure swings about the undercarriage structure. The slewing assist system includes a central rotation member coupled to the undercarriage structure. The central rotation member rotates with the undercarriage structure. A slip member is concentrically coupled to the central rotation member. The slip member is adapted to allow a rotational motion of the central rotation member relative to the slip member. At least one pin is coupled to the slip member. The at least one pin movable between a retracted position and an expanded position. The at least one pin engages the slip member with the central rotation member in the expanded position such that the central rotation member and the slip member rotate together.

A lever arm is fixedly coupled to the slip member. A first end and a second end of an actuating element are coupled to the lever arm and the upper structure. The slewing assist system provides additional slewing assist to the upper body structure through the lever arm by engaging the slip member and the central rotation member through the at least one pin. The second end of the actuating element is extended to assist in a first rotational direction, and is retracted to assist in a second rotational direction.

In another aspect of the present disclosure, a slewing assist system for a machine is provided. The machine has an upper body structure supported on an undercarriage structure such that the upper body structure swings about the undercarriage structure. The slewing assist system includes a central rotation member coupled to the undercarriage structure such that the central rotation member rotates with the undercarriage structure. A slip member concentrically coupled to the central rotation member, and is adapted to allow a rotational motion of the central rotation member relative to the slip member. At least one pin movable between a retracted position and an expanded position is coupled to the slip member. The at least one pin engages the slip member with the central rotation member in the expanded position such that the central rotation member and the slip member rotate together. A lever arm is fixedly coupled to the slip member. An actuating element has a first end coupled to the lever arm and a second end coupled to the upper structure. A controller is communicably coupled to the slip member, the at least one pin, and the actuating element. The controller provides additional slewing assist to the upper body structure through the lever arm by engaging the slip member and the central rotation member through the at least one pin. The second end of the actuating element is extended to assist in a first rotational direction, and retracted to assist in a second rotational direction.

In yet another aspect of the present disclosure, a machine is provided. The machine includes an upper body structure supported on the undercarriage structure such that the upper body structure swings about the undercarriage structure. A slew gear assembly coupled to the upper body structure. A slew drive is coupled to the slew gear assembly. The slew drive drives the slew gear assembly to swing the upper body structure relative to the undercarriage structure. A slewing assist system is coupled to the undercarriage structure and the upper body structure. The slewing assist system includes a central rotation member coupled to the undercarriage structure such that the central rotation member rotates with the undercarriage structure. A slip member is concentrically coupled to the central rotation member and is adapted to allow a rotational motion of the central rotation member relative to the slip member. At least one pin coupled to the slip member and movable between a retracted position and an expanded position. The at least one pin engages the slip member with the central rotation member in the expanded position such that the central rotation member and the slip member rotate together. A lever arm is fixedly coupled to the slip member. A first end of an actuating element is coupled to the lever arm, and a second end of the actuating element is coupled to the upper structure. The slewing assist system provides additional slewing assist to the upper body structure through the lever arm by engaging the slip member and the central rotation member through the at least one pin. The second end of the actuating element is extended to assist in a first rotational direction, and retracted to assist in a second rotational direction.

DETAILED DESCRIPTION

Figure 1:
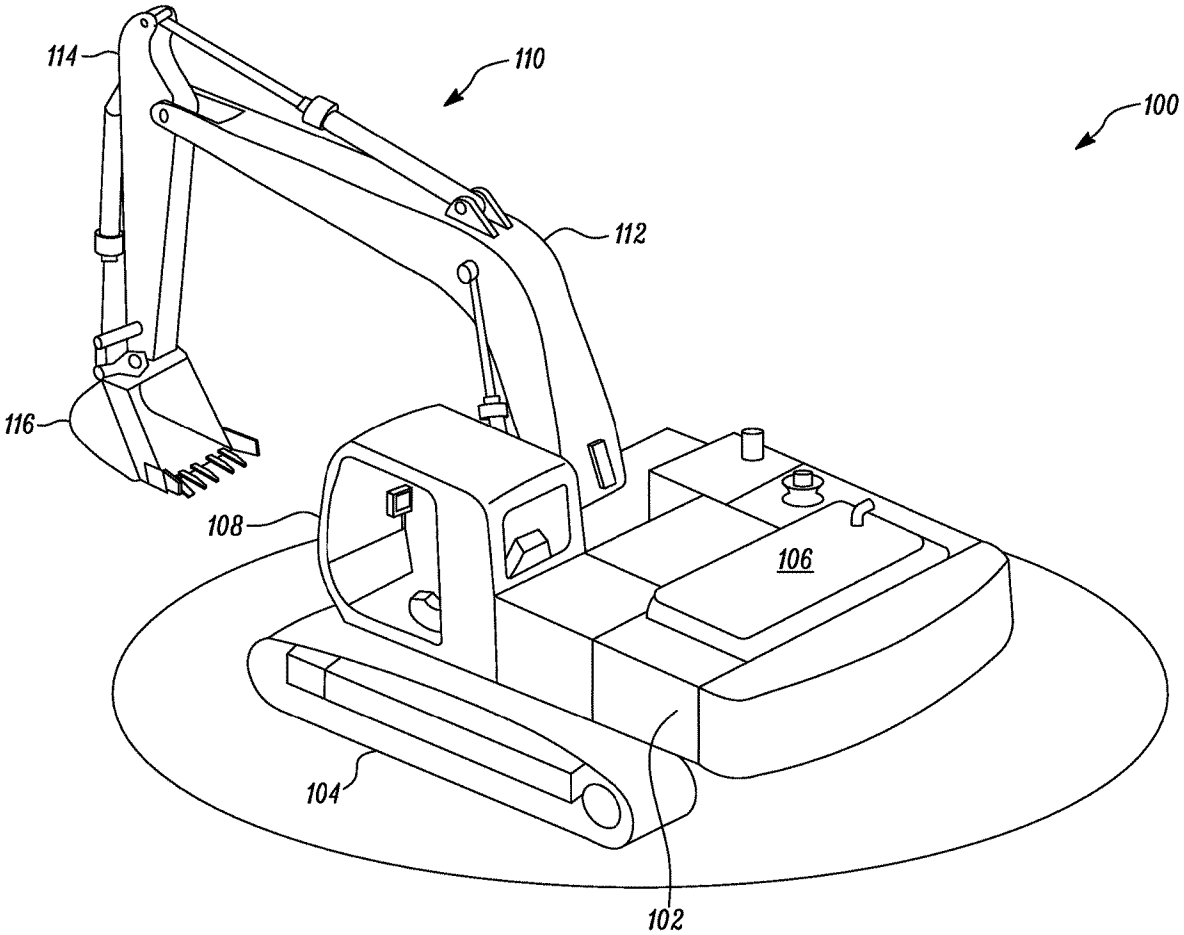
FIG. 1 is a perspective view of an exemplary machine, in accordance with an embodiment of the present disclosure.

Wherever possible, the same reference numbers will be used throughout the drawings to refer to same or like parts. FIG. 1 shows an exemplary machine 100. The machine 100 is illustrated as an excavator which may be used, for example, for construction, mining, and other such industries. While the following detailed description describes an exemplary aspect in connection with the excavator, it should be appreciated that the description applies equally to the use of the present disclosure in other machines as well.

The machine 100 includes an upper body structure 102 supported on an undercarriage structure 104. Although, the undercarriage structure 104 is illustrated as continuous tracks, it should be contemplated that the undercarriage structure 104 may be any other type of ground engaging element as well, for example, wheels etc. The upper body structure 102 swings about the undercarriage structure 104 defining a slewing movement. The upper body structure 102 includes an engine compartment 106 and an operator cabin 108. The machine 100 also includes a work tool 110 having a boom 112 operably coupled to an arm 114 for operating a bucket 116.

Figure 2A:
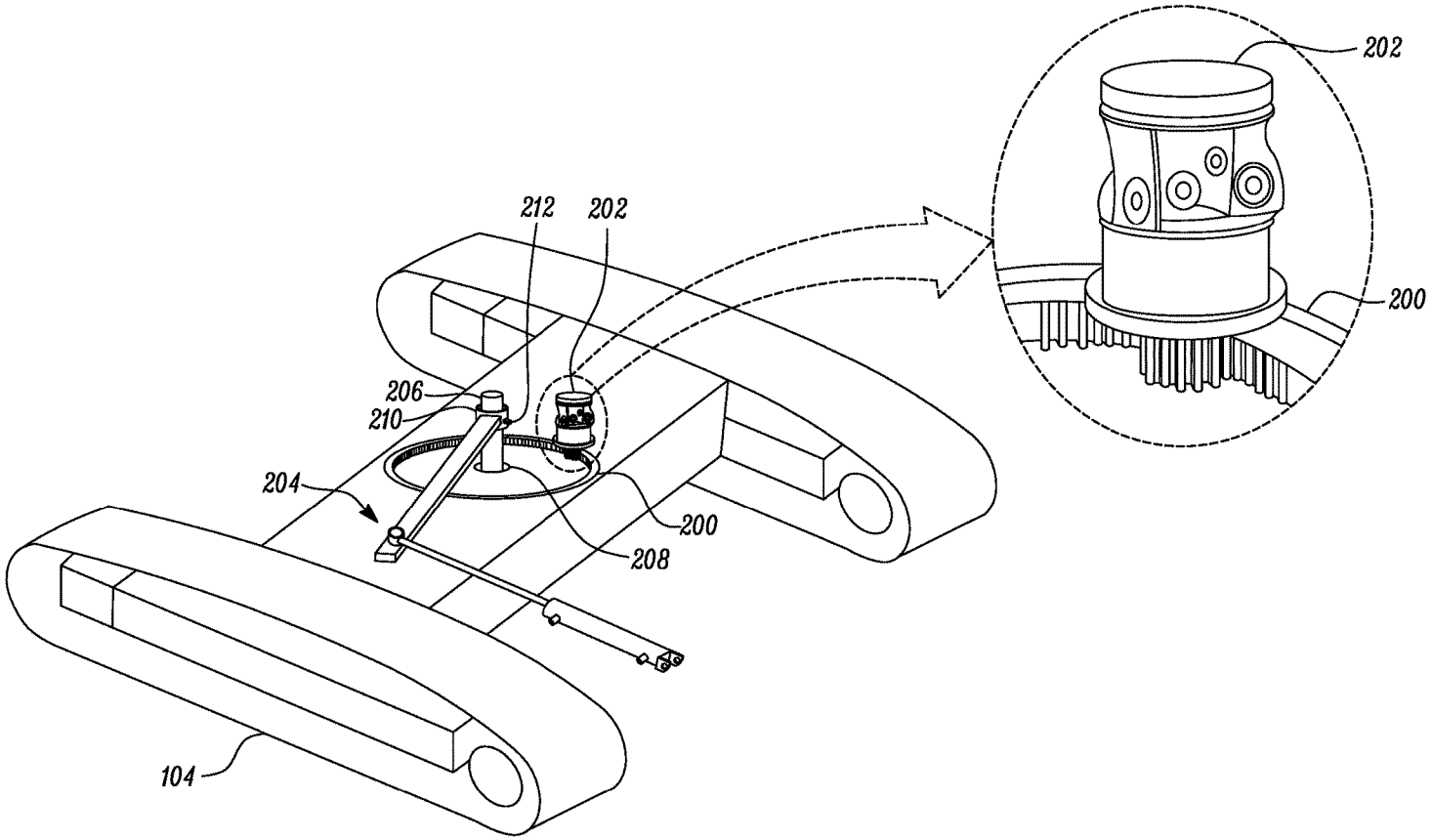
FIGS. 2A and 2B show perspective views of a slewing assist system coupled to an undercarriage structure of the machine, in accordance with various embodiments of the present disclosure.

FIG. 2A illustrates a view with the upper body structure 102 not shown. It should be understood that the upper body structure 102 is not shown only for the sake of clearly showing components underneath. The upper body structure 102 remains an integral part of the machine 100. Now referring together to FIGS. 1 and 2A, the machine 100 further includes a slew gear assembly 200. As the upper body structure 102 remains an integral part of the machine 100 without being shown in FIG. 2A, the slew gear assembly 200 is integrally coupled to the upper body structure 102 such as the movement of the slew gear assembly 200 initiates the slewing movement of the upper body structure 102. In some embodiments, the slew gear assembly 200 is fixedly coupled to the upper body structure 102. In other embodiments, the slew gear assembly 200 is movably coupled to the upper body structure 102 via some intermediary means (not shown). A slew drive 202 is operably coupled to the slew gear assembly 200. The slew drive 202 drives the slew gear assembly 200 so as to swing the upper body structure 102 relative to the undercarriage structure 104. In some embodiments, the slew drive 202 may include a mechanical, an electric, a hydraulic, a pneumatic, or any other suitable drive. In some embodiments, the slew drive 202 may include multiple slew drives for providing the slewing movement to the upper body structure 102.

Further referring to FIG. 2A, a slewing assist system 204 is coupled to the undercarriage structure 104. The slewing assist system 204 includes a central rotation member 206. The central rotation member 206 is coupled to the undercarriage structure 104 such that the central rotation member 206 rotates with the undercarriage structure 104. In some embodiments, the central rotation member 206 may be a shaft, a stick, or a pivot suitable for various embodiments of the present disclosure. As shown, the central rotation member 206 is coupled to the undercarriage structure 104 via a central pivot point 208. It must be contemplated that the central pivot point 208 supports fixed coupling of the central rotation member 206 to the undercarriage structure 104.

The slewing assist system 204 further includes a slip member 210 concentrically coupled to the central rotation member 206. The slip member 210 is adapted to allow a rotational motion of the central rotation member 206 relative to the slip member 210. In some embodiments, the slip member 210 may be a bearing-like element with proper lubrication to allow the rotational motion of the central rotation member 206. A pin 212 is coupled to the slip member 210. The pin 212 may be coupled to the slip member 210 by any suitable joining mechanism which may be suitable as per the need of the present disclosure.

Figure 2B:
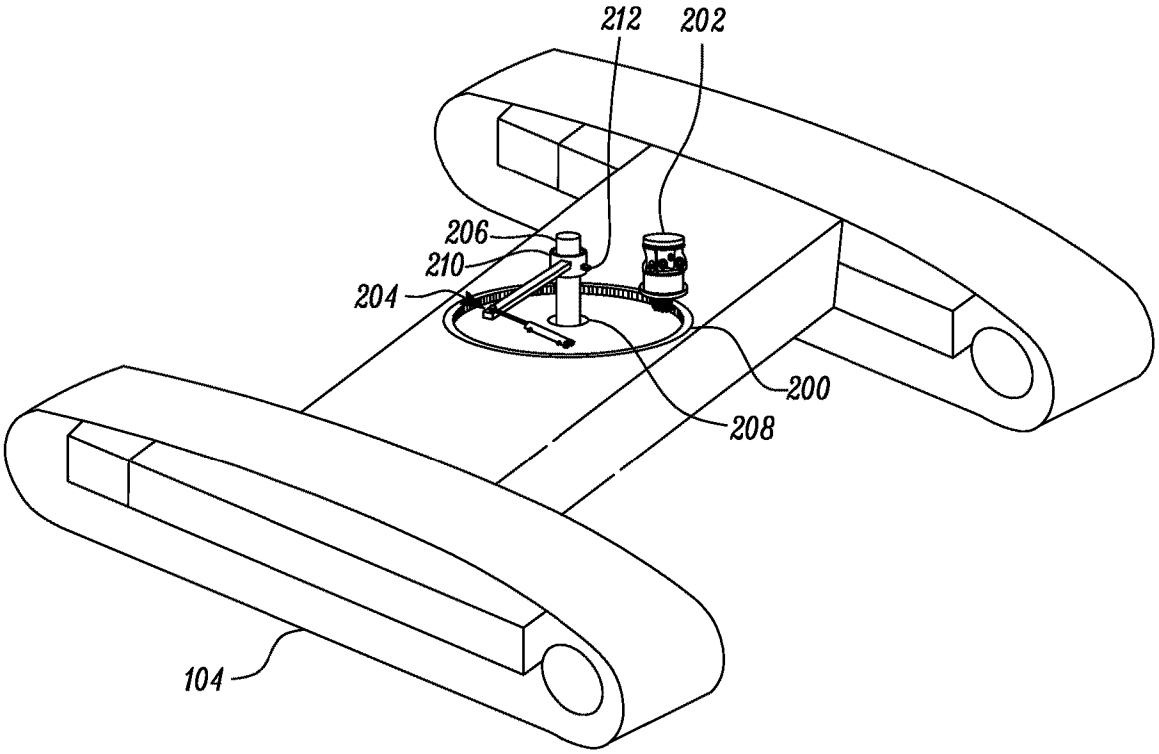

FIG. 2B depicts the slewing assist system 204 coupled to the undercarriage structure 104, according to another embodiment of the present disclosure. As shown, the slewing assist system 204 is sized in a manner such that it completely resides within the slew gear assembly 200. In an embodiment, a size of the slewing assist system 204 may be based upon factors including, for example, a size of the upper body structure 102, a magnitude of the slewing assist required, load being handled by the bucket 116, or a location of the mounting position of the slewing assist system 204 to the upper body structure 102, among others. The slewing assist system 204 is further shown in the top view of FIG. 3.

Figure 3:
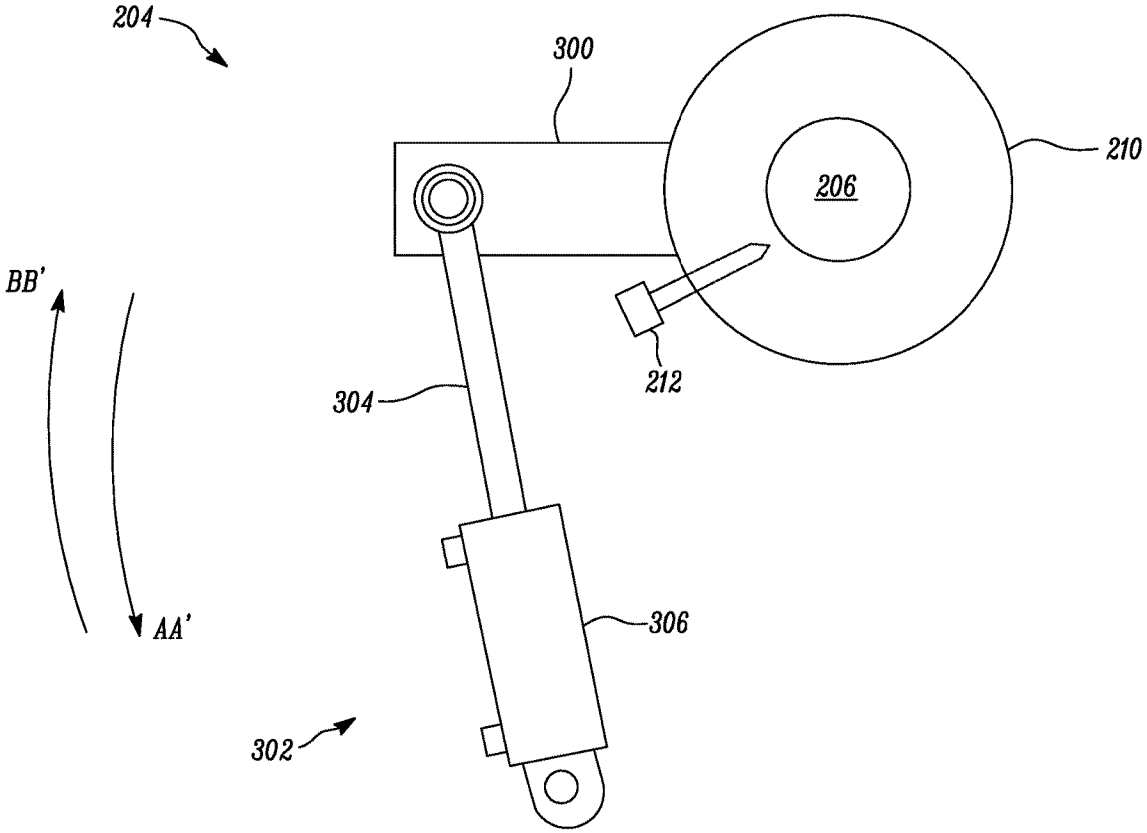
FIG. 3 is a top view of the slewing assist system of the machine, in accordance with an embodiment of the present disclosure.

As shown in FIG. 3, the slewing assist system 204 includes a lever arm 300 fixedly coupled to the slip member 210. The lever arm 300 is further coupled to an actuating element 302. In some embodiments, the actuating element 302 is a piston-cylinder assembly. In an embodiment, the actuating element 302 may be actuated by at least one of a hydraulic means or a pneumatic means. The actuating element 302 has a first end 304 and a second end 306. In the illustrated embodiment, the actuating element 302 is a piston-cylinder assembly. The first end 304 is shown as a rod-end of the piston-cylinder assembly and the second end 306 is shown as a head-end of the piston-cylinder assembly. The second end 306 is a double actuating cylinder. The first end 304 of the actuating element 302 is coupled to the lever arm 300. The second end 306 of the actuating element 302 may be coupled to the upper body structure 102 for providing the additional assist in the slewing movement.

The pin 212 of the slewing assist system 204 is movable between an expanded position and a retracted position. FIG. 3 shows the pin 212 in the retracted position. In an embodiment, the pin 212 may have any shape which may be suitable as per application requirements. The pin 212 may be actuated by any suitable actuation means (not shown) which may provide required actuation force to the pin 212. In some embodiments, the actuation means may include at least one of a mechanical actuation means, an electrical actuation means, or an electromechanical actuation means. It should be contemplated that the present disclosure is not limited to type of actuation of the pin 212 in any manner.

Figure 4:
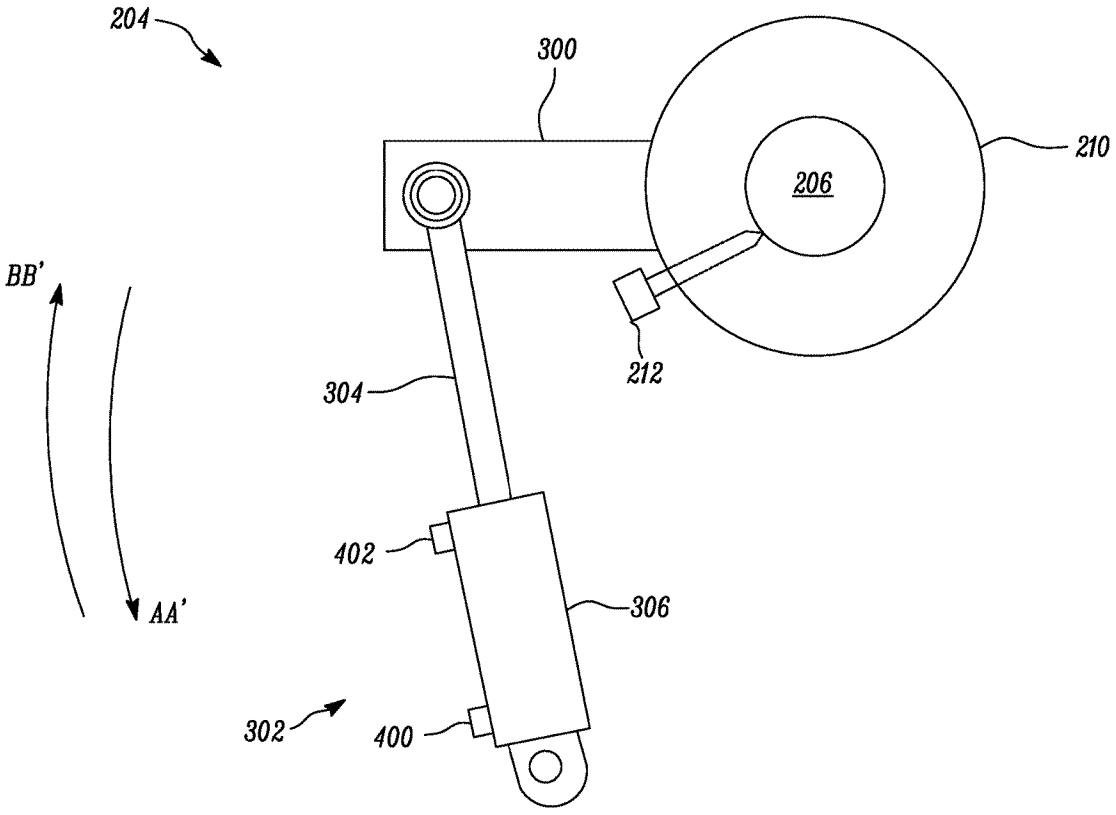
FIG. 4 is another top view of the slewing assist system of the machine, in accordance with an embodiment of the present disclosure.

Now referring to FIG. 4, the slewing assist system 204 is shown in another top view. In the exemplary embodiment, the pin 212 is shown in the expanded position when actuated by the actuating means. The pin 212 engages the slip member 210 with the central rotation member 206 in the expanded position such that the central rotation member 206 and the slip member 210 rotate together. In this configuration, the slewing assist system 204 may provide the slewing assistance to the upper body structure 102 via the actuating element 302. The slewing assist system 204 provides additional slewing assist to the upper body structure 102 in a first rotational direction AA' through the lever arm 300 by engaging the slip member 210 and the central rotation member 206 through the pin 212, and extending the second end 306 of the actuating element 302. In some embodiments, the second end 306 of the actuating element 302 may be extended by providing an actuating fluid (not shown) in a first inlet 400. Similarly, the slewing assist system 204 provides additional slewing assist to the upper body structure 102 in a second rotational direction BB' through the lever arm 300 by engaging the slip member 210 and the central rotation member 206 through the pin 212, and retracting the second end 306 of the actuating element 302. In some embodiments, the second end 306 of the actuating element 302 may be extended by providing the actuating fluid in a second inlet 402 and simultaneously withdrawing the actuating fluid from the first inlet 400.

Figure 5:
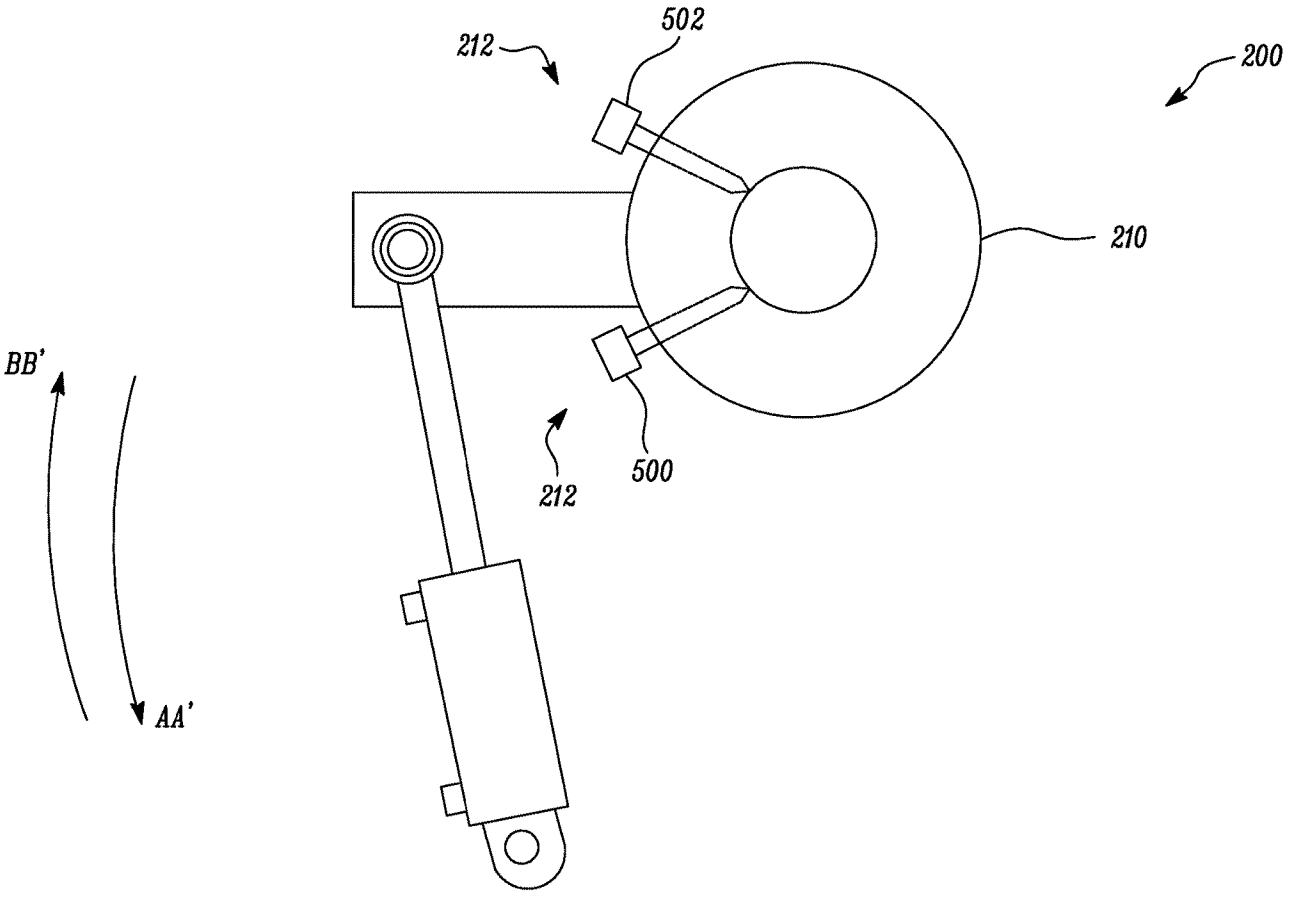
FIG. 5 is a top view of the slewing assist system of the machine, in accordance with an embodiment of the present disclosure.

FIG. 5 depicts another top view of the slewing assist system 204. The slewing assist system 204 includes a first pin 500 and a second pin 502. The first pin 500 and the second pin 502 are shown in the expanded positions. The first pin 500 provides additional slewing assist in the first rotational direction AA' and the second pin 502 provides additional slewing assist in the second rotational direction BB'. It must be contemplated that the number of pins and their arrangement may be altered within the scope of the present disclosure, such as, for example to increase the strength of engagement of the pins with the slip member 210, or to maximize the additional assist to the upper structure 102 in any particular angular direction relative to the undercarriage structure 104.

Figure 6:
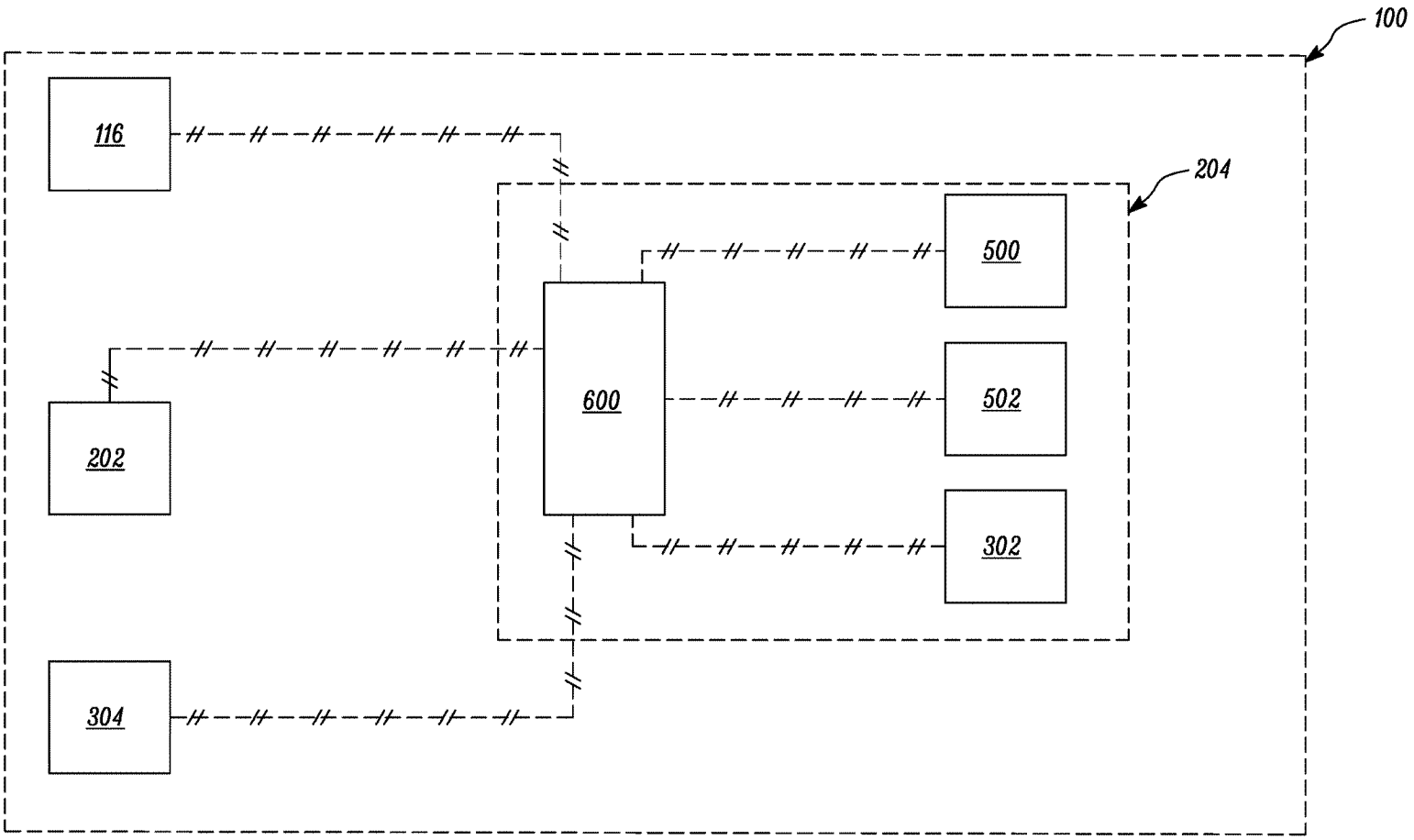
FIG. 6 is a schematic view depicting the slewing assist system of the machine having a controller, in accordance with an embodiment of the present disclosure.

As depicted in the FIG. 6, the slewing assist system 204 includes a controller 600 communicably coupled to the first pin 500, the second pin 502, and the actuating element 302. The controller 600 may be a single controller or multiple controllers working together to perform a variety of tasks. The controller 600 may embody a single or multiple microprocessors, field programmable gate arrays (FPGAs), digital signal processors (DSPs), etc., that include a means for providing the additional slewing assist to the upper body structure 102. Numerous commercially available microprocessors can be configured to perform the functions of the controller 600. Various known circuits may be associated with the controller 600, including power supply circuitry, signal-conditioning circuitry, actuator driver circuitry (i.e., circuitry powering solenoids, motors, or piezo actuators), and communication circuitry.

The controller 600 may control the actuation of the first pin 500 and the second pin 502 between the retracted position and the expanded position. In some embodiments, the controller 600 may control the actuation of the first pin 500 and the second pin 502 between the retracted position and the expanded position based on at least one of a bucket load, an engine load, an operator command, and a rotational speed of the upper body structure 102. The controller 600 may further utilize any other such parameters as well to control the actuation of the first pin 500 and the second pin 502 based on application requirements. The present disclosure, in any manner, is not limited by the parameters being used by the controller 600 to control the motion of the first pin 500 and the second pin 502.

INDUSTRIAL APPLICABILITY

The present disclosure provides a slewing assist system 204 associated with the machine 100. In an embodiment, the machine 100 is switched on and is operating to excavate underwater or in other such conditions requiring the additional assist for the slewing movement. In some embodiments, the operator is operating the bucket 116 and giving the slewing movement to the upper body structure 102 by operating the slew drive 202. The slew drive 202 rotates the slew gear assembly 200, which in turn provides the slewing movement to the upper body structure 102. In some embodiments, the operator may operate the undercarriage structure 104 of the machine 100 as well.

The machine 100 may be provided the additional assist by using the slewing assist system 204. In some embodiments, the controller 600 may receive data about a bucket load from the bucket 116. In other embodiments, the controller 600 may receive data from the slew drive 202 about the resistance or load during the slewing movement of the machine 100. In some embodiments, the undercarriage structure 104 may provide data about the ground environment or material in which the machine 100 is operating by a traction sensor (not shown) mounted on the undercarriage structure 104, or any other suitable place on the machine 100. Data about the engine load or the rotational speed of the upper body structure 102 may be other relevant parameters for providing the additional assist.

The controller 600 may decide to provide the additional assist based on the above parameters, or after receiving an express command from the operator. In some embodiments, the controller 600 may actuate the first pin 500 and the second pin 502. In other embodiments, the controller 600 actuates the pin 212. The controller 600 then may actuate the actuating element 302 by providing the fluid in the first inlet 400 or the second inlet 402, based on the requirement of providing additional assist in a particular rotational direction (AA' or BB'). The second end 306 may extend or retract based on the above actuation by the controller 600.

The slewing assist system 204 of the present disclosure provides additional assist only when required, and thus prevents the need for having the slew drive 202 designed for higher power than required by the present system design requirements of the machine 100, eliminating very high initial capital costs. Further, the overall size of the slew drive 202 may be much smaller in comparison due to the lower power requirements, providing better efficiency. The slewing assist drive 204 of the present disclosure may also be beneficial in cases where existing or older machines have to be used for dredging or other such operations. The slewing assist drive 204 may be retrofitted in the existing or older machines, making them useful for handling more tasks requiring heavy slewing movements.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A slewing assist system for a machine, the machine having an upper body structure supported on an undercarriage structure such that the upper body structure swings about the undercarriage structure, the slewing assist system comprising:

a central rotation member coupled to the undercarriage structure, wherein the central rotation member rotates with the undercarriage structure;

a slip member concentrically coupled to the central rotation member, wherein the slip member is adapted to allow a rotational motion of the central rotation member relative to the slip member;

at least one pin coupled to the slip member, the at least one pin movable between a retracted position and an expanded position, wherein the at least one pin engages the slip member with the central rotation member in the expanded position such that the central rotation member and the slip member rotate together;

a lever arm fixedly coupled to the slip member; and an actuating element having a first end and a second end, wherein the first end of the actuating element is coupled to the lever arm, and the second end of the actuating element is coupled to the upper structure;

wherein the slewing assist system provides additional slewing assist to the upper body structure through the lever arm by engaging the slip member and the central rotation member through the at least one pin, and extending the second end of the actuating element to assist in a first rotational direction, and retracting the second end of the actuating element to assist in a second rotational direction.

2. The slewing assist system of claim 1, wherein the at least one pin may includes a first pin and a second pin configured to provide additional slewing assist in the first and second rotational directions, respectively.

3. The slewing assist system of claim 2, further comprising a controller communicably coupled to the first pin, the second pin, and the actuating element.

4. The slewing assist system of claim 3, wherein the controller controls actuation of the first pin and the second pin between the retracted position and the expanded position based on at least one of a bucket load, an engine load, an operator command, and a rotational speed of the upper body structure.

5. The slewing assist system of claim 1, wherein the at least one pin can be actuated through at least one of a mechanical actuation means, an electrical actuation means, or an electromechanical actuation means.

6. The slewing assist system of claim 1, wherein the actuating element is a piston-cylinder assembly.

7. The slewing assist system of claim 1, wherein the actuating element is actuated by at least one of a hydraulic means or a pneumatic means.

8. A slewing assist system for a machine, the machine having an upper body structure supported on an undercarriage structure such that the upper body structure swings about the undercarriage structure, the slewing assist system comprising:

a central rotation member coupled to the undercarriage structure, wherein the central rotation member rotates with the undercarriage structure;

a slip member concentrically coupled to the central rotation member, wherein the slip member is adapted to allow a rotational motion of the central rotation member relative to the slip member;

at least one pin coupled to the slip member, the at least one pin movable between a retracted position and an expanded position, wherein the at least one pin engages the slip member with the central rotation member in the expanded position such that the central rotation member and the slip member rotate together;

a lever arm fixedly coupled to the slip member;

an actuating element having a first end and a second end, wherein the first end of the actuating element is coupled to the lever arm, and the second end of the actuating element is coupled to the upper structure; and a controller communicably coupled to the slip member, the at least one pin, and the actuating element, the controller configured to:

provide additional slewing assist to the upper body structure through the lever arm by engaging the slip member and the central rotation member through the at least one pin, and extending the second end of the actuating element to assist in a first rotational direction, and retracting the second end of the actuating element to assist in a second rotational direction.

9. The slewing assist system of claim 8, wherein the at least one pin may includes a first pin and a second pin configured to provide additional slewing assist in the first and second rotational directions, respectively.

10. The slewing assist system of claim 9, wherein the controller controls actuation of the first pin and the second pin between the retracted position and the expanded position based on at least one of a bucket load, an engine load, an operator command, and a rotational speed of the upper body structure.

11. The slewing assist system of claim 8, wherein the at least one pin can be actuated through at least one of a mechanical actuation means, an electrical actuation means, or an electromechanical actuation means.

12. The slewing assist system of claim 8, wherein the actuating element is a piston-cylinder assembly.

13. The slewing assist system of claim 12, wherein the actuating element is actuated by at least one of a hydraulic means or a pneumatic means.

14. A machine comprising:

an undercarriage structure;

an upper body structure supported on the undercarriage structure such that the upper body structure swings about the undercarriage structure;

a slew gear assembly coupled to the upper body structure;

a slew drive coupled to the slew gear assembly, wherein the slew drive is configured to drive the slew gear assembly to swing the upper body structure relative to the undercarriage structure; and a slewing assist system coupled to the undercarriage structure and the upper body structure, the slewing assist system including:

a central rotation member coupled to the undercarriage structure, wherein the central rotation member rotates with the undercarriage structure;

a slip member concentrically coupled to the central rotation member, wherein the slip member is adapted to allow a rotational motion of the central rotation member relative to the slip member;

at least one pin coupled to the slip member, the at least one pin movable between a retracted position and an expanded position, wherein the at least one pin engages the slip member with the central rotation member in the expanded position such that the central rotation member and the slip member rotate together;

a lever arm fixedly coupled to the slip member; and an actuating element having a first end and a second end, wherein the first end of the actuating element is coupled to the lever arm, and the second end of the actuating element is coupled to the upper structure;

wherein the slewing assist system provides additional slewing assist to the upper body structure through the lever arm by engaging the slip member and the central rotation member through the at least one pin, and extending the second end of the actuating element to assist in a first rotational direction, and retracting the second end of the actuating element to assist in a second rotational direction.

15. The machine of claim 14, wherein the at least one pin may includes a first pin and a second pin configured to provide additional slewing assist in the first and second rotational directions, respectively.

16. The machine of claim 15, further comprising a controller communicably coupled to the first pin, the second pin, and the actuating element.

17. The machine of claim 16, wherein the controller controls actuation of the first pin and the second pin between the retracted position and the expanded position based on at least one of a bucket load, an engine load, an operator command, and a rotational speed of the upper body structure.

18. The machine of claim 14, wherein the at least one pin can be actuated through at least one of a mechanical actuation means, an electrical actuation means, or an electromechanical actuation means.

19. The machine of claim 14, wherein the actuating element is a piston-cylinder assembly.

20. The machine of claim 14, wherein the actuating element is actuated by at least one of a hydraulic means or a pneumatic means.

* * * * *